US007152737B2

(12) United States Patent
Chin

(10) Patent No.: US 7,152,737 B2
(45) Date of Patent: Dec. 26, 2006

(54) OPENABLE ASSEMBLY WITH GRIPPING AIDS AND FOLDING MEANS

(75) Inventor: Henry Young Chin, Portland, OR (US)

(73) Assignee: The Procter & Gamble Company, Cincinnati, OH (US)

( * ) Notice: Subject to any disclaimer, the term of this patent is extended or adjusted under 35 U.S.C. 154(b) by 138 days.

(21) Appl. No.: 10/448,896

(22) Filed: May 30, 2003

(65) Prior Publication Data

US 2003/0194157 A1 Oct. 16, 2003

Related U.S. Application Data

(62) Division of application No. 09/990,528, filed on Nov. 21, 2001, now abandoned.

(60) Provisional application No. 60/253,774, filed on Nov. 29, 2000.

(51) Int. Cl.
*B65D 73/00* (2006.01)
*B65D 69/00* (2006.01)
*B65D 33/16* (2006.01)

(52) U.S. Cl. ..... 206/494; 206/233; 383/97

(58) Field of Classification Search ..... 206/494, 206/223, 440, 449, 581, 525, 810, 812, 823, 206/233; 24/387, 381, 433, 435, 436; 150/118; 190/119, 903; 221/49, 64; 383/66, 97; D3/301, 239, 205
See application file for complete search history.

(56) References Cited

U.S. PATENT DOCUMENTS

| | | | | | |
|---|---|---|---|---|---|
| D101,439 | S | * | 10/1936 | Doppelt | D3/301 |
| D106,132 | S | * | 9/1937 | Doppelt | D3/301 |
| 2,099,853 | A | * | 11/1937 | Konelsky | 150/118 |
| 2,114,683 | A | | 4/1938 | Kates | |
| 2,561,042 | A | * | 7/1951 | Berel et al. | 190/119 |
| 2,574,345 | A | * | 11/1951 | Montgomery | 206/494 |
| 3,720,303 | A | * | 3/1973 | Giaque | 206/525 |
| 4,131,195 | A | * | 12/1978 | Worrell, Sr. | 206/205 |
| 4,494,592 | A | | 1/1985 | Bonner | |
| 4,561,525 | A | * | 12/1985 | Shidner | 190/106 |
| 4,570,820 | A | * | 2/1986 | Murphy | 221/34 |
| D292,645 | S | * | 11/1987 | Young | D3/245 |
| 4,856,570 | A | * | 8/1989 | Rushing et al. | 150/107 |
| 4,877,139 | A | | 10/1989 | Kim | |
| 5,007,143 | A | | 4/1991 | Herrington | |
| 5,008,971 | A | | 4/1991 | Stewart, Sr. | |
| 5,131,121 | A | | 7/1992 | Herrington, Jr. et al. | |
| 5,664,299 | A | | 9/1997 | Porchia et al. | |
| 5,916,280 | A | | 6/1999 | Lantz | |

(Continued)

FOREIGN PATENT DOCUMENTS

EP 0 761 117 A 3/1997

(Continued)

*Primary Examiner*—Mickey Yu
*Assistant Examiner*—J. Gregory Pickett
(74) *Attorney, Agent, or Firm*—Ian S. Robinson; Matthew P. Fitzpatrick; Sarah Ann Dressel

(57) ABSTRACT

An openable closure assembly including: a) a base having two end edges, a front longitudinal side and a back longitudinal side, a top surface and a bottom surface; b) an opening mechanism mounted on the top surface of the base adjacent to and spaced from both of the longitudinal side edges; c) at least one gripping aid joined to an end edge of the opening mechanism. Also disclosed are packages comprising the closure assembly. Additionally disclosed are securement loops which can be attached to the package bottom panel and into which the gripping aids can be inserted.

12 Claims, 5 Drawing Sheets

U.S. PATENT DOCUMENTS

| | | | | |
|---|---|---|---|---|
| 6,067,816 | A | 5/2000 | Hodosh | |
| 6,068,113 | A | 5/2000 | Schmaling et al. | |
| 6,273,470 | B1 * | 8/2001 | Bullock | 281/29 |
| 6,550,635 | B1 * | 4/2003 | King et al. | 221/49 |

FOREIGN PATENT DOCUMENTS

| | | | |
|---|---|---|---|
| FR | 1 130 567 | A | 2/1957 |
| WO | WO 99/15128 | A | 4/1999 |

* cited by examiner

Fig. 9
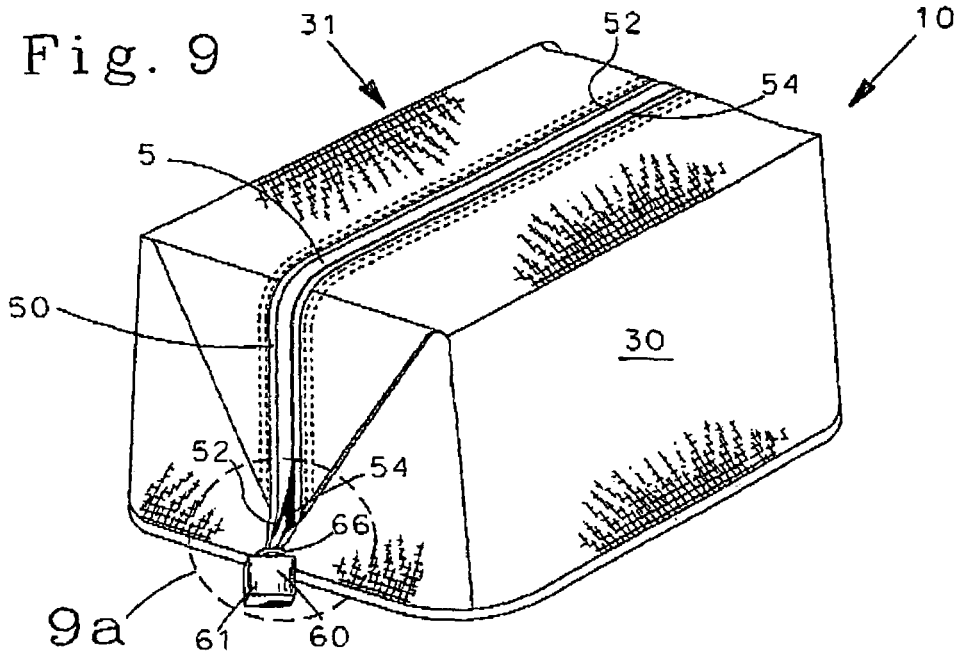
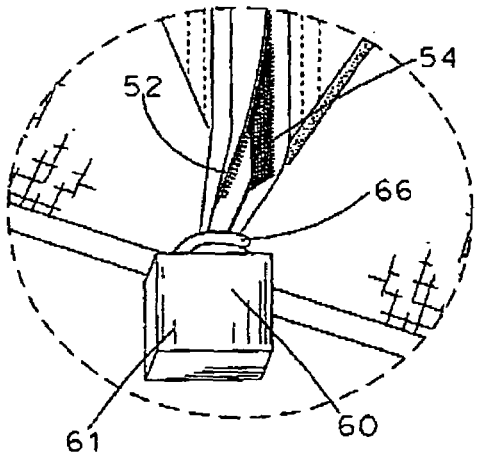
Fig. 9a

OPENABLE ASSEMBLY WITH GRIPPING AIDS AND FOLDING MEANS

RELATED U.S. APPLICATION DATA

Divisional of application Ser. No. 09/990,528, filed on Nov. 21, 2001 now abandoned, which is a non-provisional of provisional application No. 60/253,774, filed on Nov. 29, 2000.

TECHNICAL FIELD

The present invention relates to an openable assembly which can be mounted on a package or other structure. The openable assembly preferably includes at least one gripping aid to facilitate opening and/or closing of the device. In certain embodiments, the gripping aid can also be used to secure the package in a folded or other desirable configuration.

BACKGROUND OF THE INVENTION

Openable packages of various types are well known in the packaging art. In many cases, it is desirable for the package to include an opening mechanism such that the package itself need not be torn or destroyed during opening. Further, it may be desirable to have a reclosable opening mechanism to provide the user with the ability to open and close the package several times. Such reclosable opening mechanisms include zippers, hook and loop closures and ZIP-LOCK™ type slide closures. Typical slide-zippers are disclosed in U.S. Pat. Nos. 5,007,143; 5,008,971; 5,131,121 and 5,664,299. Openable, but generally not reclosable perforations are also well known in the art, one example of which is described in U.S. Pat. No. 4,877,139.

Because the act of sliding a zipper or opening a perforation or hook and loop closure is a relatively simple manual movement, a large open area can be quickly and easily closed using these devices. However, persons, such as the handicapped, the elderly and young children whose manual strength and dexterity are not fully developed can benefit from additional aids in handling/gripping the object to be opened and/or closed.

Accordingly, it would be desirable to provide a closure system which is easy to grasp. It would also be desirable to provide a closure assembly having a gripping aid that helps the user manage the device during opening and/or closing. Further, it would be desirable to provide a package with a closure assembly having a gripping aid that helps users such as small children, the elderly or physically challenged users to grip and manage the closure assembly during use.

SUMMARY OF THE INVENTION

An openable closure assembly comprising a base having, two end edges, a first longitudinal side and a second longitudinal side; a closure mechanism comprising a first portion and a second portion, the closure mounted on said base adjacent to and spaced apart from said longitudinal sides; and at least one gripping aid joined to at least one of the end edges of said opening mechanism.

In one embodiment, the present invention provides an openable assembly where the closure mechanism is a zipper and gripping aids are disposed at each end of the closure assembly. Such an embodiment could provide a reusable package in the form of a two-sided pouch, a four-sided package, etc. especially useful for containing sheet-like articles.

In other embodiments, the present invention may provide a disposable package comprising a closure assembly including a perforation and/or may contain any number of different articles.

BRIEF DESCRIPTION OF THE DRAWINGS

FIG. 9 is a front perspective view of a package including an embodiment of the openable closure assembly in closed configuration.

FIG. 9*a* is a close-up view of an embodiment of the openable closure assembly in closed configuration.

DETAILED DESCRIPTION OF THE INVENTION

Figure 1:
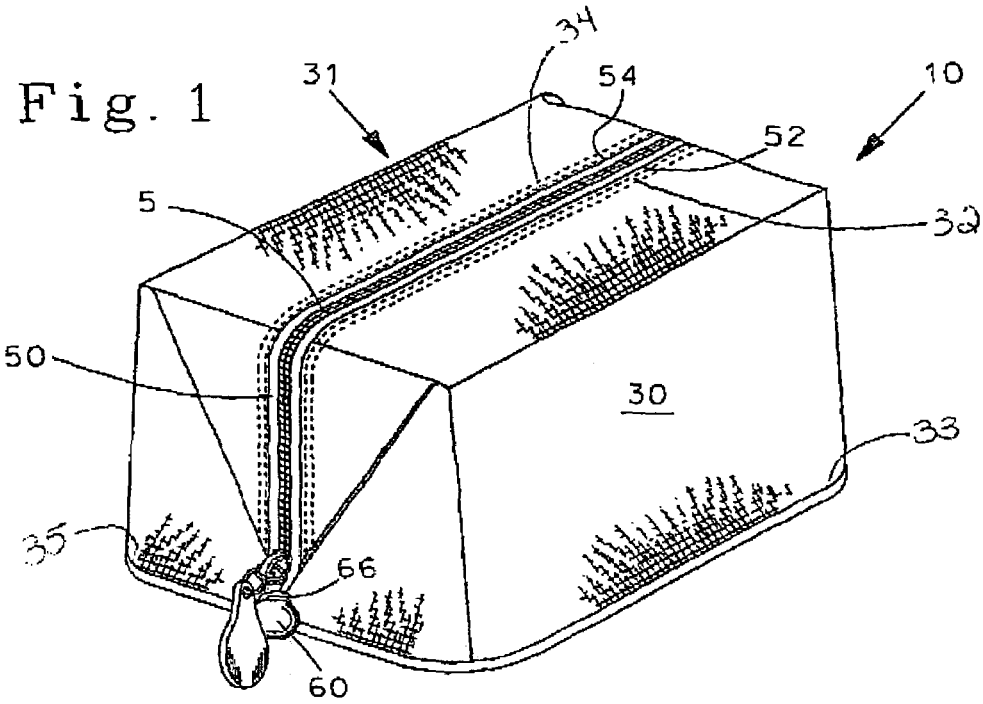
FIG. 1 is a front perspective view of a package including an embodiment of the openable closure assembly in closed position.
Figure 5:
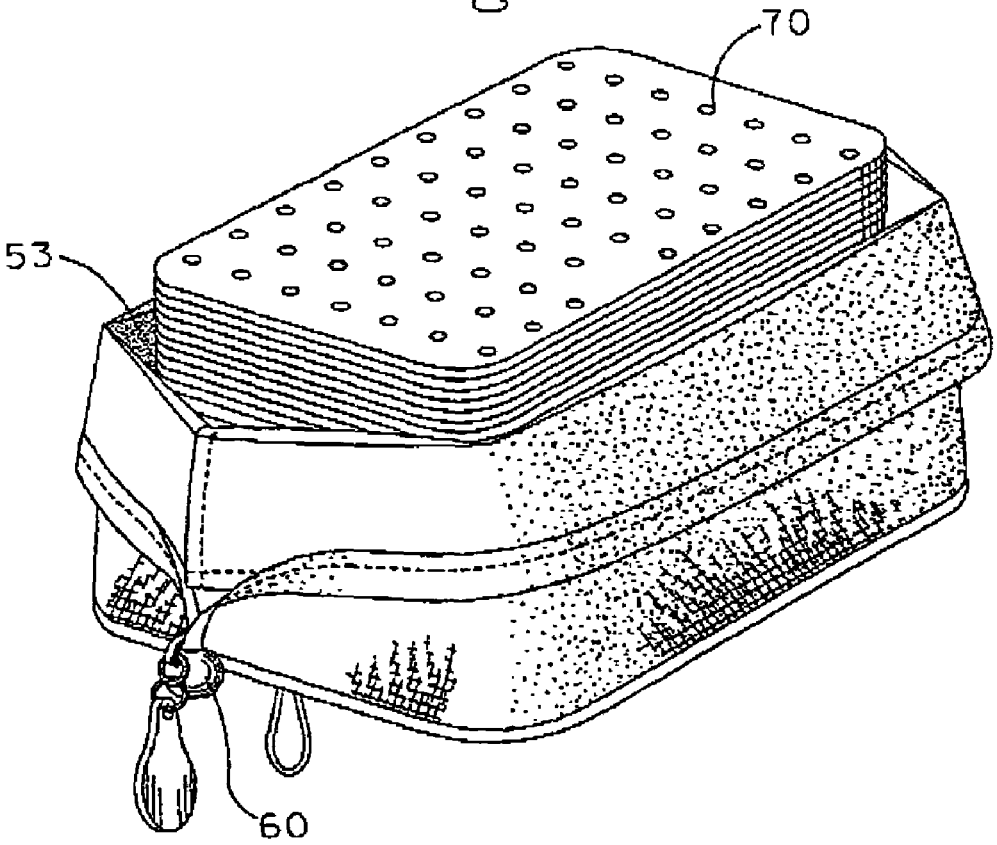
FIG. 5 is a front perspective view of the package of FIG. 1 in an open configuration.

The present invention is directed to an openable closure assembly with gripping aids to facilitate the opening and/or closing of the assembly. The closure assembly of the present invention may be used alone or in conjunction with any type of package of other structure. In one embodiment, as shown in FIG. 1, the closure assembly 5 may be associated with a package 10. The package 10 may be of any type, size, and shape and may be made from any suitable materials such as films polyester, polyethylene and polypropylene films and/or coated and uncoated fabrics. The package 10 may be durable (i.e., reusable) or may be disposable (i.e., intended to be discarded after use). Further, the package 10 may include any type of contents or may be empty. In a preferred embodiment, the package 10 may be suitable for storing a multiplicity of sheets of material such as wiping sheets or disposable wash cloths. An example of such a package including a multiplicity of sheets of material 70 is shown in FIG. 5.

Figure 2:
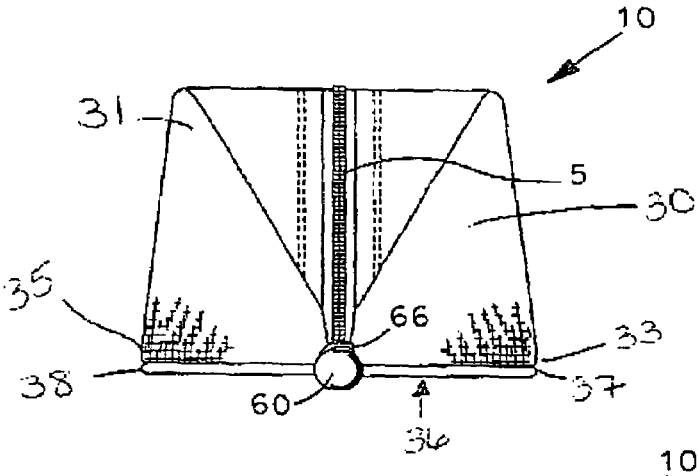
FIG. 2 is a side view of the package of FIG. 1.
Figure 3:
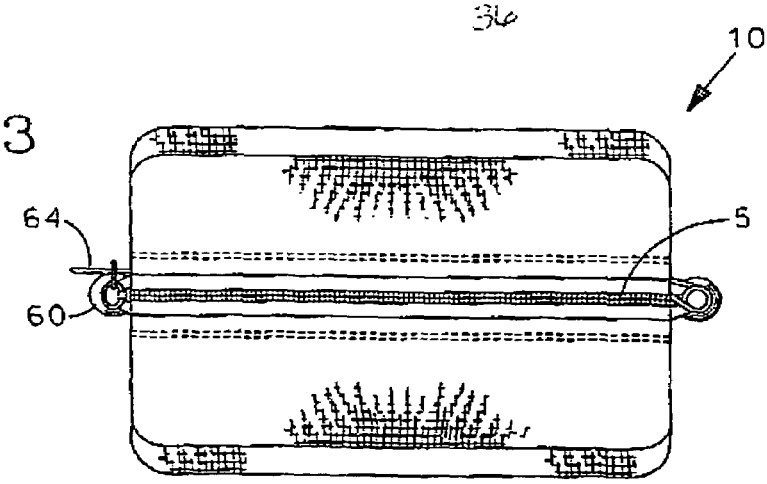
FIG. 3 is a top plan view of the package of FIG. 1.
Figure 6:
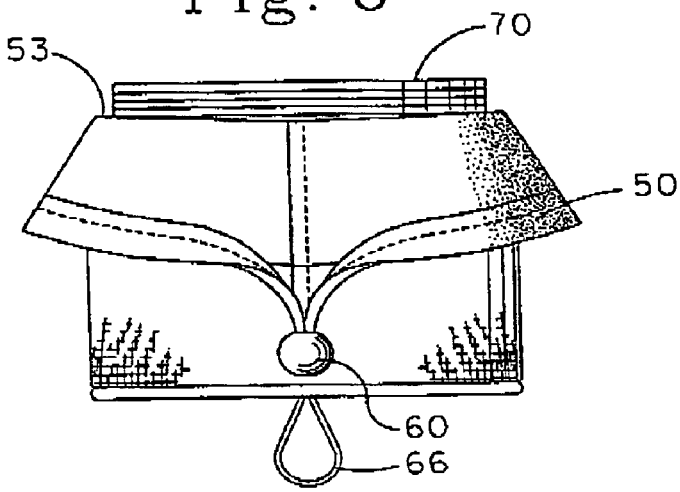
FIG. 6 is a side view of the package of FIG. 5.

The openable closure assembly 5 of the present invention preferably includes a closure mechanism having a first portion 52 and a second portion 54. The first portion 52 and the second portion 54 interact with each other to provide the closure assembly with a closed configuration, as is show in FIGS. 1 and 2. The interaction between the first portion 52 and the second portion 54 can be mechanical, chemical, magnetic, static, adhesive, frictional or any other type of interaction which provides the desired closure properties for the particular package. In one embodiment, the first and second portions of the closure assembly 5 may include the teeth of a zipper. In other exemplary embodiments, the first portion may include a loop and the second portion can include a hook which is engageable with the loop. In yet other embodiments, the first and second portions can include adhesives fasteners, ZIP-LOCK™ type closures elements, or any combination of known closure elements, such as those referred to herein and others known in the art. In yet other embodiments, the first portion 52 and the second portion 54 may comprise the same material or materials separated only be a perforation or a line of weakness. In any case, when the first and second portions of the closure assembly 5 are not interacting with each other, the closure assembly is considered in an open configuration, as is shown in FIGS. 5 and 6.

The first portion 52 of the closure assembly 5 and/or the second portion 54 may be joined directly to the package or structure for which the openable closure assembly 5 is being provided, or may be joined to a base structure which is in turn joined to the package or structure. The base 50 provides a transition region between the first and second portions of the closure assembly and the package or structure to which the closure assembly 5 is attached. The transition region may make it easier to join the closure assembly to the article in situations where the first and/or second portions are generally incompatible with the rest of the package or structure to which the closure assembly 5 is joined. For example, the teeth of a zipper are often joined to a strip of material, or base, which is joined to the article implementing the closure device. The base 50 may be made from any suitable material and may be of any suitable size. The base 50 may also provide the article with other structural or aesthetic advantages, such as strength, color, breathability, etc. In any case, the base 50 provides a convenient structure onto which the first portion 52, the second portion 54 or any other part of the closure assembly 5 may be mounted.

Figure 9B:
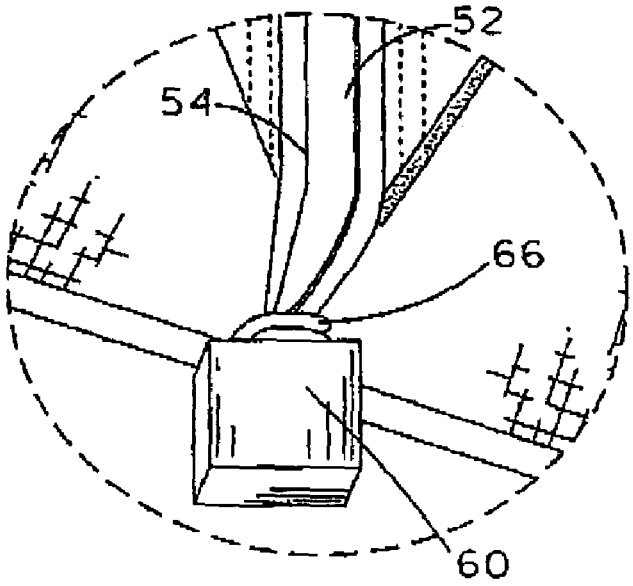
FIG. 9*b* is a close-up view of an embodiment of the openable closure assembly in closed configuration as well as an embodiment of the gripping aid.
Figure 9C:
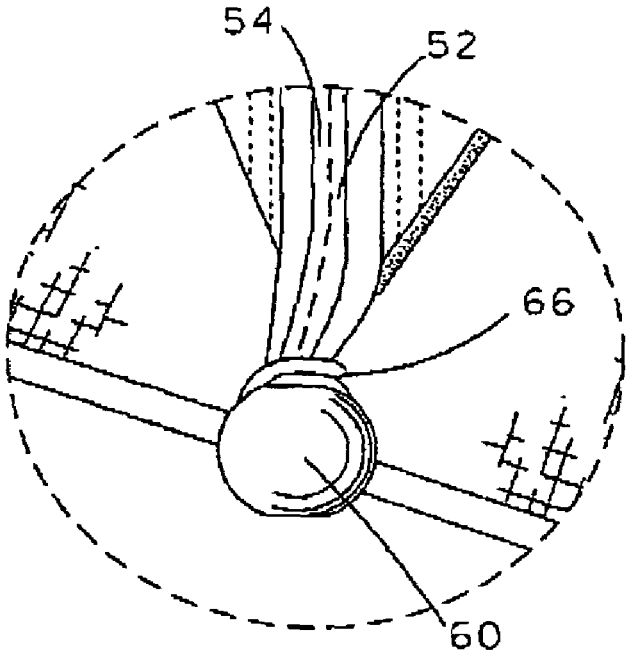
FIG. 9*c* is a close-up view of an embodiment of the openable closure assembly in closed configuration.

The closure assembly 5 of the present invention preferably also includes at least one gripping aid 60. The gripping aid 60 provides the user of the article with a convenient and easy to grip structure which can aid in the opening and/or closing of the closure assembly 5. The gripping aid 60 can be any structure that helps the user with the functioning of the closure assembly 5. For example, as shown in FIG. 1, the gripping aid 60 can be a generally spherical member joined to one end of the closure assembly 5. In other embodiments, the gripping aid can be other shapes or sizes. In any of the embodiments, the gripping aid 60 can include adhesive, frictional, suction or other forces to aid the user grip the closure device. In one such embodiment, (such as exemplified in FIGS. 9 and 9*a*) the gripping aid 60 may include a tab coated with a pressure sensitive adhesive 61 which is skin friendly, yet which provides the user with an aid to grip a potion of the closure assembly 5.

The gripping aid 60 should be of sufficient size, shape or other properties (e.g., adhesiveness) to make the closure assembly easier to grasp and hold than without the gripping aid 60. In one preferred embodiment, the gripping aid 60 may be in the general shape of a sphere, a semi-sphere, or a cube. Although the size of the gripping aid 60 is not critical, it has been found that a shape having a diameter or width of at least about ½ inch (about 1.25 cm) is generally preferred. Much larger diameters and widths ranging anywhere from about ½ inch (1.25 cm) to about 10 inches (about) 25.4 cm have also been found to be sufficient and/or desirable in certain embodiments. Further, smaller diameters and widths ranging from about ¼ inch (about 0.635 cm) to about ½ inch (about 1.25 cm) have also been found to be sufficient in certain embodiments.

Figure 4:
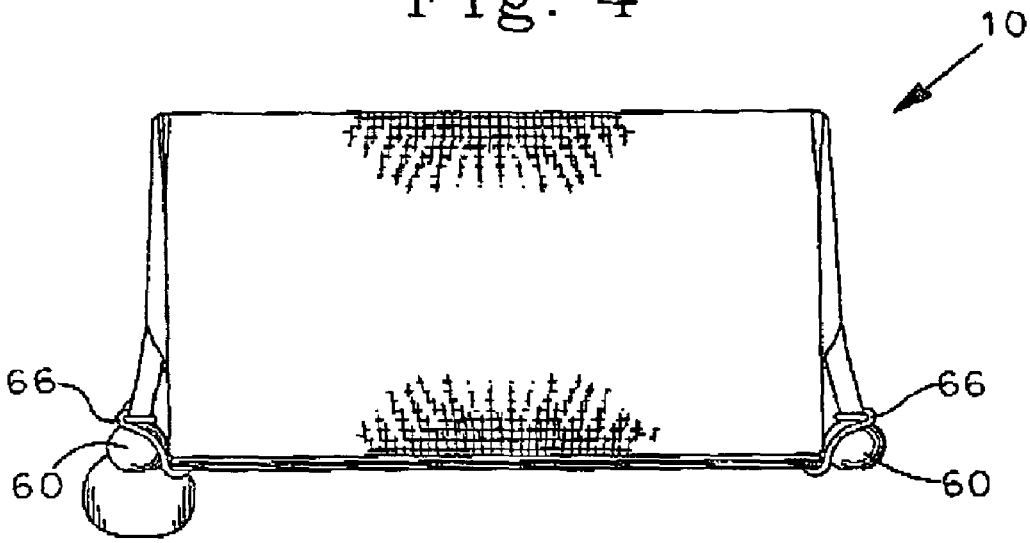
FIG. 4 is an elevational view of the package of FIG. 1.
Figure 7:
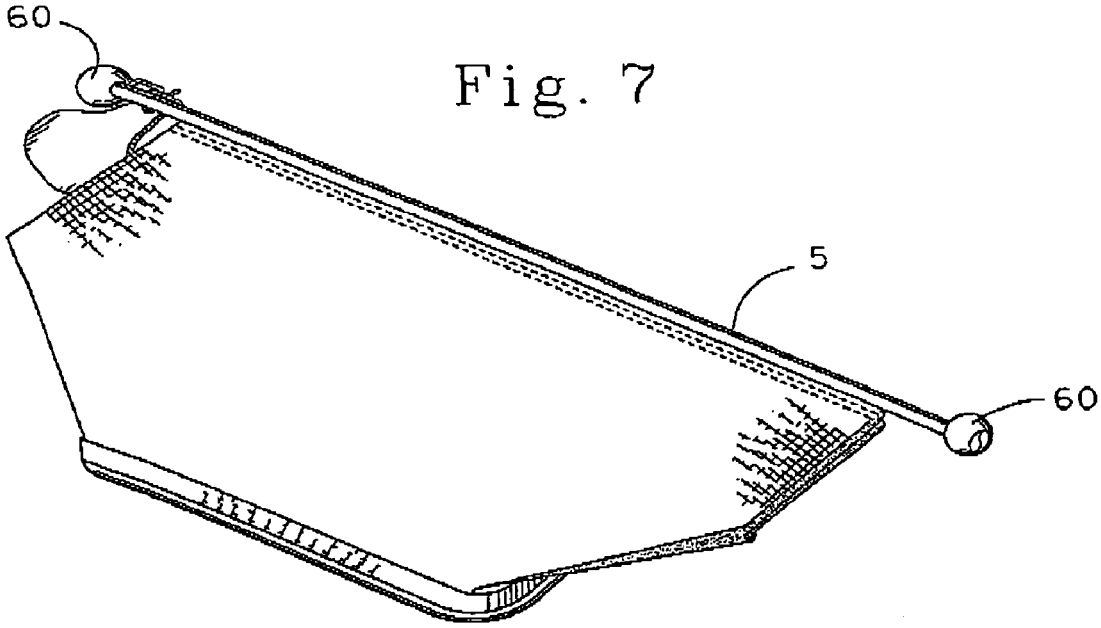
FIG. 7 is a perspective view of the package of FIG. 1 empty and folded flat.
Figure 8:
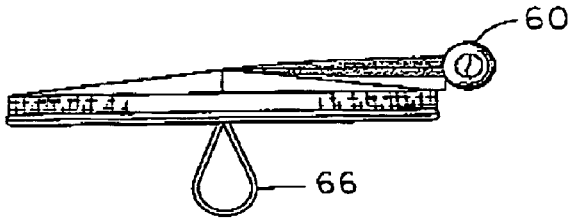
FIG. 8 is a right side view of the package of FIG. 7.

As shown in FIGS. 1–8, one preferred embodiment of the present invention includes a closure assembly 5 including at least one gripping aid 60 disposed adjacent at least one of the ends of the closure assembly 5. However, as shown in FIGS. 4 and 7, it may be desirable to provide the closure assembly with at least two gripping aids 60, one adjacent each end of the closure assembly 5. The gripping aids 60 disposed adjacent one or more of the ends of the closure assembly 5 provide the user with a convenient way to grasp that portion of the closure assembly 5 while opening or closing the assembly. This is especially useful for sliding type closure assemblies, such as zippers and ZIP-LOCK™ type fasteners wherein the user must grasp one end of the closure mechanism and slide another part toward or away from that end. The gripping aid 60 helps the user immobilize one end of the closure assembly 5 so that the opening or closing motion is smooth. This function is especially helpful for packages and other devices which are intended to be opened or closed by children, the elderly or physically challenged users who may not have the dexterity or physical capabilities to manage typical sliding closure systems.

In one embodiment, the present invention may take the form of a package 10 especially useful for children, the elderly or physically challenged users containing a cleaning wipe or other sheet-like article. As shown in FIG. 5, the sheets 70 may be stacked inside the package 10 on top of each other, although any other configuration can be used. The package 10 may include a first panel 30 and a second panel 31 which are joined and provide an opening 53. The first panel 30 has first 32 and second 33 longitudinal edges. The second panel 31 has first 34 and second 35 longitudinal edges. The base 50 of the closure assembly 5 is joined to the package about the opening 53. The first portion 52 and the second portion 54 of the closure mechanism are joined to the base 50. In this embodiment, the closure assembly 5 includes two gripping aids 60, one on each end of the closure assembly 5. The gripping aids 60 are shown to be in the shape of enlarged generally spherical elements. As shown in FIG. 7, the closure assembly 5 extends beyond the opening in the package 10. The gripping aids 60 are shown located outwardly from the opening 53 at each end of the closure assembly 5. This configuration is especially helpful for zipper and ZIP-LOCK™ type closure because it allows the user to completely open or close the package 10 without the zipper or other sliding mechanism getting in the way of the opening. The package 10 may optionally include a bottom panel 36. The bottom panel 36 has a first edge 37 and a second edge 38. In embodiments in which a bottom panel 36 is present in the package 10, the first edge 37 of the bottom panel 36 is joined to the second longitudinal edge 33 of the first panel 30 and the second edge 38 of the bottom panel 36 is joined to the second longitudinal edge 35 of the second panel 31.

In certain embodiments of the present invention, the gripping aid 60 may also provide an additional benefit to the user other than facilitating opening or closing of the closure assembly 5. For example, the gripping aid may be use to hold a portion of the package in a particular configuration. In one embodiment, as shown in FIGS. 1 and 4, the gripping aids 60 may be used to keep a portion of the package 10 in a folded configuration. This is especially useful for irregularly shaped packages because it can make shipping and handling easier without the need for extra packaging. However, in other configurations, the gripping aids can be used to hold the package 10 open, attach packages to each other or other structures and the like.

The additional benefits described above with respect to the gripping aid 60, can be provided by any known structure which interacts with the griping aid 60. In one embodiment, the package 10 may include loops, hereinafter referred to as securement loops 66, joined on the package 10 into which the gripping aids 60 can be inserted. Although elastic loops are preferred in certain embodiments, other materials or types of structures other than loops are contemplated.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A kit for facilitating use of sheets of material by users having less than fully developed manual strength and dexterity, said kit comprising:

a) a multiplicity of sheets of material; and b) a package containing said multiplicity of sheets of material, said package having an opening comprising:

i) a first panel having first and second longitudinal edges and a second panel having first and second longitudinal edges;

ii) an openable closure assembly having open and closed configurations and a first end edge and a second end edge and comprising a closure mechanism including a first portion and a second portion, wherein said first portion of said closure mechanism is joined to said first longitudinal edge of said first panel and said second portion of closure mechanism is joined to said first edge of said second panel; and iii) a three-dimensional gripping aid comprising a spherical or cubical shape to facilitate grasping that is joined to at least one of said end edges of said closure assembly;

wherein, said package further comprises securement loops at its base that interact with said gripping aid to help maintain said package in a secured configuration;

wherein, when said closure mechanism is in said open configuration, said user is free to access said sheets of material through said opening and, when said closure mechanism is in said closed configuration, said user is prevented from accessing said sheets of material.

2. A kit according to claim 1 wherein said sheets of material comprise wiping sheets.

3. A kit according to claim 1 wherein said sheets of material comprise disposable wash cloths.

4. A kit according to claim 1 wherein said package further comprises a bottom panel having first and second edges wherein said second edge of said first panel is joined to said first edge of said bottom panel and said second edge of said second panel is joined to said second edge of said bottom panel.

5. A kit according to claim 1 wherein said closure mechanism is selected from the group consisting of zippers, hook and loop closures, adhesive fasteners and perforations.

6. A kit according to claim 1 wherein said gripping aid is coated with a pressure sensitive adhesive.

7. A kit according to claim 1 wherein said package is disposable.

8. A kit according to claim 1 wherein said package is reusable.

9. A kit according to claim 1 wherein said first and second portions each have a portion length, said portion lengths being equal, and said first edges of said first and second panels each have a panel length, said panel lengths being equal, wherein said portion lengths are greater than said panel lengths so that said portions extend beyond said first and second panels such that at least one of said end edges of said closure assembly is located outboard of said opening.

10. A kit according to claim 1 wherein said interaction maintains said package in a folded configuration.

11. A kit according to claim 10 wherein said folded configuration of said package is substantially parallelepipedal.

12. A kit for facilitating use of sheets of material by users having less than fully developed manual strength and dexterity, said kit comprising:

a) a multiplicity of disposable wash cloths; and b) a package containing said multiplicity of disposable wash cloths, said package having an opening comprising:

i) a first panel having first and second longitudinal edges and a second panel having first and second longitudinal edges;

ii) an openable closure assembly having open and closed configurations and a first end edge and a second end edge and comprising a closure mechanism including a first portion and a second portion, wherein said first portion of said closure mechanism is joined to said first longitudinal edge of said first panel and said second portion of closure mechanism is joined to said first edge of said second panel;

iii) a bottom panel having first and second edges wherein said second edge of said first panel is joined to said first edge of said bottom panel and said second edge of said second panel is joined to said second edge of said bottom panel; and iv) a three-dimensional gripping aid comprising a spherical or cubical shape to facilitate grasping that is joined to at least one of said end edges of said closure assembly;

wherein, said package further comprises securement loops at its base that interact with said gripping aid to help maintain said package in a secured configuration;

wherein, when said closure mechanism is in said open configuration, said user is free to access said disposable wash cloths through said opening and, when said closure mechanism is in said closed configuration, said user is prevented from accessing said disposable wash cloths.

* * * * *